US005855698A

United States Patent [19]

Gu

[11] Patent Number: 5,855,698

[45] Date of Patent: Jan. 5, 1999

[54] ENGINE CYLINDER BLOCK CAST WITH COMPONENT ZONES HAVING DIFFERENT MATERIAL PROPERTIES

[75] Inventor: Yongping Gu, Rochester Hills, Mich.

[73] Assignee: Ford Global Technologies, Inc., Dearborn, Mich.

[21] Appl. No.: 799,058

[22] Filed: Feb. 10, 1997

Related U.S. Application Data

[63] Continuation-in-part of Ser. No. 544,215, Oct. 17, 1995, abandoned.

[51] Int. Cl.[6] ..... C22C 37/04

[52] U.S. Cl. ..... 148/902; 148/321; 148/323

[58] Field of Search ..... 148/902, 321, 148/323

[56] References Cited

U.S. PATENT DOCUMENTS 4,057,098 11/1977 Platonov et al. .

4,419,801 12/1983 Yamashita et al. .

FOREIGN PATENT DOCUMENTS

0565503 A1 4/1993 European Pat. Off. .

WO93/20969 10/1993 WIPO .

*Primary Examiner*—Deborah Yee

*Attorney, Agent, or Firm*—Jerome R. Drouillard

[57] ABSTRACT

An iron casting, such as a cylinder block for an internal combustion engine, includes a number of component zones, with each of the zones having selected surface to volume ratio and selected section thickness sufficient to cause in-mold cooling during the casting process at controllable, but varying rates sufficient to result in predetermined, different percentages of nodular and compacted graphite iron in at least two of the zones of the cylinder block or other iron casting.

7 Claims, 2 Drawing Sheets

ENGINE CYLINDER BLOCK CAST WITH COMPONENT ZONES HAVING DIFFERENT MATERIAL PROPERTIES

This is a continuation-in-part application of U.S. patent application Ser. No. 08/544,215, filed Oct. 17, 1995, now abandoned.

BACKGROUND OF THE INVENTION

1. Technical Field

The present invention relates to iron casting in a manner which produces a unitary workpiece having different material properties in different zones of the casting, with such differing properties being produced during the molding process.

2. Description of Related Art

Grey iron has been used in castings since the dawn of the automotive age. Iron is inexpensive and is relatively easy to cast. It does, however, suffer from comparison of its strength and stiffness with the characteristic of other materials such as steel. Although it has been known to increase the cross sectional thickness of say, a cylinder block, in order to improve engine durability and noise, vibration, and harshness characteristics, this is a costly remedy for the deficiencies of grey iron and causes a weight penalty which, those skilled in the art will appreciate, is an almost intolerable situation in the automotive business today. Those skilled in the art appreciate that grey iron, when properly doped with manganese to compensate for sulfur contained in the iron, may be cooled in such a fashion so as to produce compacted graphite iron or nodular iron. It is known conventionally to produce nodular iron gear cases for the center section of high performance rear drive vehicles, and for engine crankshafts and other highly stressed automotive components. This works quite well when the machining process is limited almost entirely to grinding. Nodular iron is, however, difficult to machine and it is more desirable to use compacted graphite iron for machinability reasons, while attaining a reasonable level of strength and stiffness. However, in the absence of the present invention, it has not been known to use preferential cooling rates to achieve both nodular and compacted graphite iron in a single casting.

SUMMARY OF THE INVENTION

A cylinder block for an internal combustion engine comprises a unitary iron casting having a number of component zones, with each of the zones having a selected surface to volume ratio and a selected section thickness sufficient to cause in-mold cooling during the casting process at controllable but varying rates which are sufficient to result in predetermined different percentages of nodular and compacted graphite iron in at least two of the zones of the cylinder block.

According to the present invention, different cooling rates sufficient to produce different properties in materials are produced by varying the surface to volume ratio and the sectional thickness of at least two of the component zones so as to cause cooling to be different in the zones when the cast metal is allowed to cool in the mold during the casting process. If an item such as a cylinder block is made according to the present invention of grey iron, the surface to volume ratio and the section thickness of each component zone may be selected to cause cooling at a rate in excess of 4.5° K/sec during cooling in the region of 1150–1000 C. for each zone in which 85% nodular iron is desired.

According to another aspect of the present invention, a method for producing a cast metal part having a plurality of component zones includes the steps of: designing a casting having a plurality of component zones which desirably have material properties which vary from at least one zone to another of the zones, with the zones having surface to volume ratios and section thicknesses specified to produce selected cooling rates during the molding process; filling a mold with a melt having a composition capable of producing such desirable material properties, with the values of such properties being dependent upon the rate of cooling during the molding process; and allowing the metal within the mold to cool at the selected cooling rates, as produced by the specified surface to volume ratios and section thicknesses, so as to give a casting which has different material properties in at least two of the component zones.

It is an advantage of the present invention that a cylinder block or other component may be produced of cast grey iron or other metals in which the material properties, such as the percentage of nodular iron and compacted graphite iron differ in various component zones located about the various areas of the casting.

DETAILED DESCRIPTION OF PREFERRED EMBODIMENTS

Figure 1:
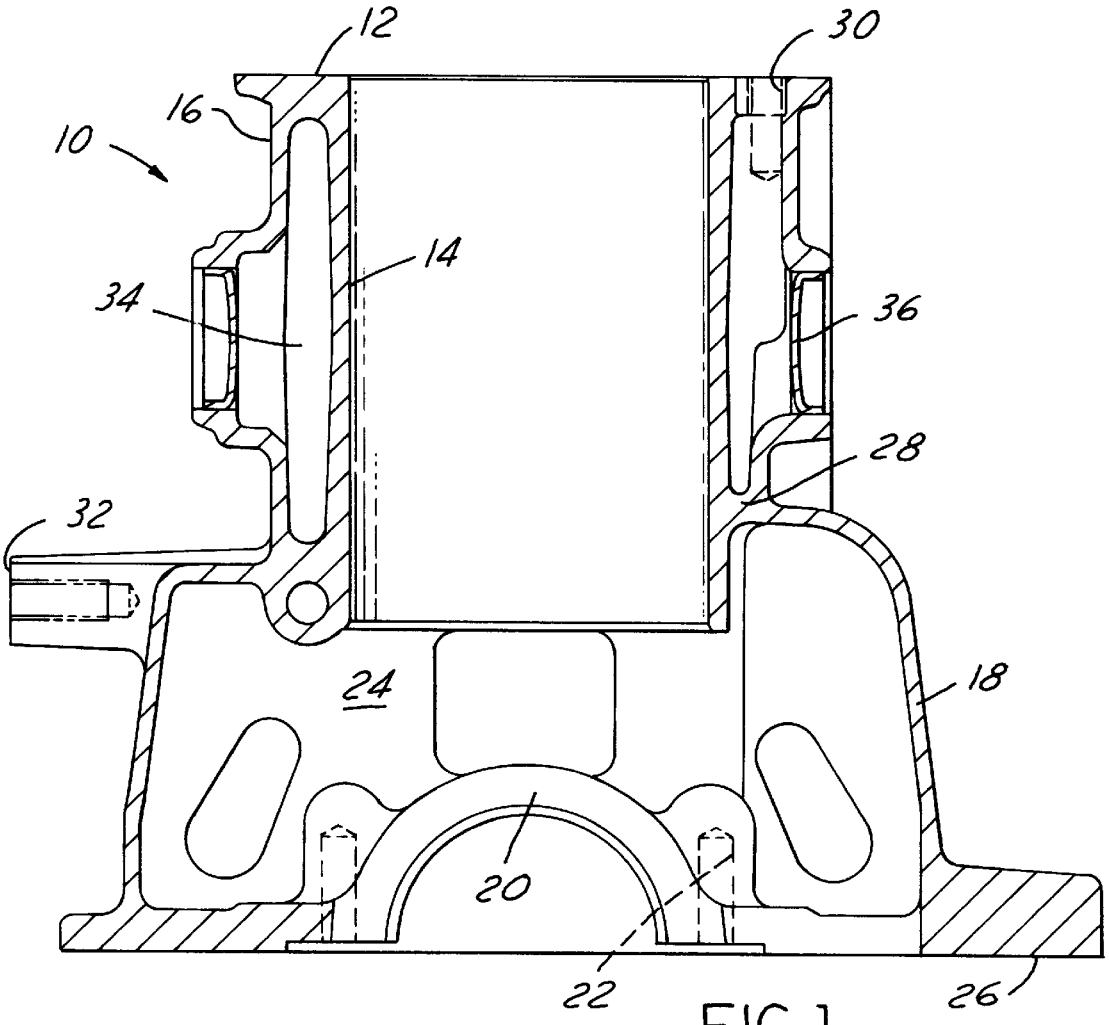
FIG. 1 is a sectional view, partly in elevation, of a cylinder block made according to the present invention.

As shown in FIG. 1, an engine cylinder block according to the present invention may be divided into 12 or more component zones, each of the zones having a selected surface to volume ratio and a selected section thickness specified so as to cause in-mold cooling during the casting process at controllable, but varying rates sufficient to result in predetermined, different percentages of nodular and compacted graphite iron in the various zones of the block. Those skilled in the art will appreciate in view of this disclosure that the differential cooling rates required to produce a cylinder block according to the present invention could be implemented through the selective use of gating in the molding process. More specifically, component zones which are specified as having compacted graphite iron, and which therefore require a slower rate of cooling than zones having nodular iron, may be situated closer to one of the gates. The added thermal inertia provided by the melt filling the gates may be used to decrease the cooling rate. Thus, the proximity of each component zone to the mold's gates may be selected to assist in provision of a desired cooling rate.

With reference to the Table shown below, a cylinder block according to the present invention may be produced with deck face 12 having a percentage of nodular iron less than 10% and with the percentage of compacted graphite iron exceeding 90%. As is shown in the table, the section thickness of deck face 12 would be about 7 mm. This section thickness, as well as all of the other data shown in the Table are merely meant to be examples of but one of a of cylinder blocks, or for that matter, other cast iron assemblies which could be constructed according to the present invention. Those skilled in the art will appreciate in view of this disclosure that the surface to volume ratio and section thickness of each of the component zones may be selected to achieve the cooling required for the particular melt to yield the desired characteristics. For example, with grey iron, to achieve less than 10% nodular iron, or said another way, to achieve a composition of compacted graphite iron in excess of 90%, it is necessary to have relatively slow cooling at a rate of less than 1.5° K/sec during cooling in the region of 1150°–1000° C. This is true with deck face 12 and bore wall 14. On the other hand, with side wall 16 and skirt 18, it is desired to have a much higher degree of nodularity, say 75%. In this case, a higher rate of cooling will be needed, with the rate falling between 2.5°–4.5° K/sec, again in the same cooling region of 1150°–1000° C. Table 1 shows various percentages of nodularity for other component zones of the cylinder block, including main bearing cap 20, at less than 10% nodularity; main bearing bolt bosses 22 and oil pan rail 26, at less than 20% nodularity; and bulkhead 24 and water jacket floor 28, at greater than 20% nodularity; other nodularities are specified for head bolt bosses 30 and mounting bolt bosses 32. According to the present invention, it is possible to provide a controlled composition or nodularity for even such parts as floor 28 of water jacket 34, which is closed in conventional fashion by means of core plug 36.

| Component Zone | Percent Nodularity | Percent Compact Graphite Iron | Section Thickness (mm) |
|---|---|---|---|
| Deckface 12 | <10 | >90 | 7 |
| Bore wall 14 | <10 | >90 | 3.5 |
| Side wall 16 | 75 | 25 | 3.4 |
| Skirt 18 | 75 | 25 | 3.4 |
| Upper main bearing cap 20 | <10 | >90 | 10 |
| Main bearing bolt boss 22 | <20 | >80 | 5 |
| Bulkhead 24 | >20 | <80 | 4 |
| Oil pan rail 26 | <20 | >80 | 15 |
| Water jacket floor 28 | >20 | <80 | 3.5 |
| Head bolt bosses 30 | <15 | >85 | 5 |
| Mounting bolt bosses 32 | <25 | >75 | 5 |

Figure 2:
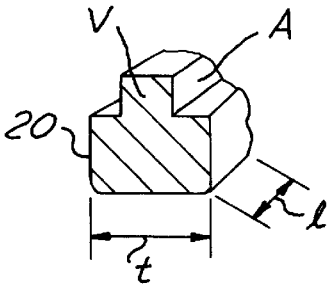
FIG. 2 illustrates a section of an upper main bearing cap according to the present invention showing a section thickness and a cross-sectional area.

According to yet another aspect of the present invention, a method for producing a cast metal part involves constructing a mold having various component zones such as deck face bore 12, bore wall 14, side wall 16, etc. Each zone will be selected, as shown in FIG. 2, having a sectional thickness, t, and a surface to volume ratio, A/V, which is sometimes termed casting modulus, which are both selected so as to cause cooling to occur at the rates which were previously discussed, depending upon the degree of nodularity sought for the particular zone in question. It should be understood that FIG. 2, which shows a section of upper main bearing cap 20, is meant to illustrate a surface to volume ratio for a unit length, 1, of a typical component zone under consideration. It should be further understood that achievement of the desired cooling rate may require that the surface to volume ratio vary along the length of a given component zone.

Figure 3:
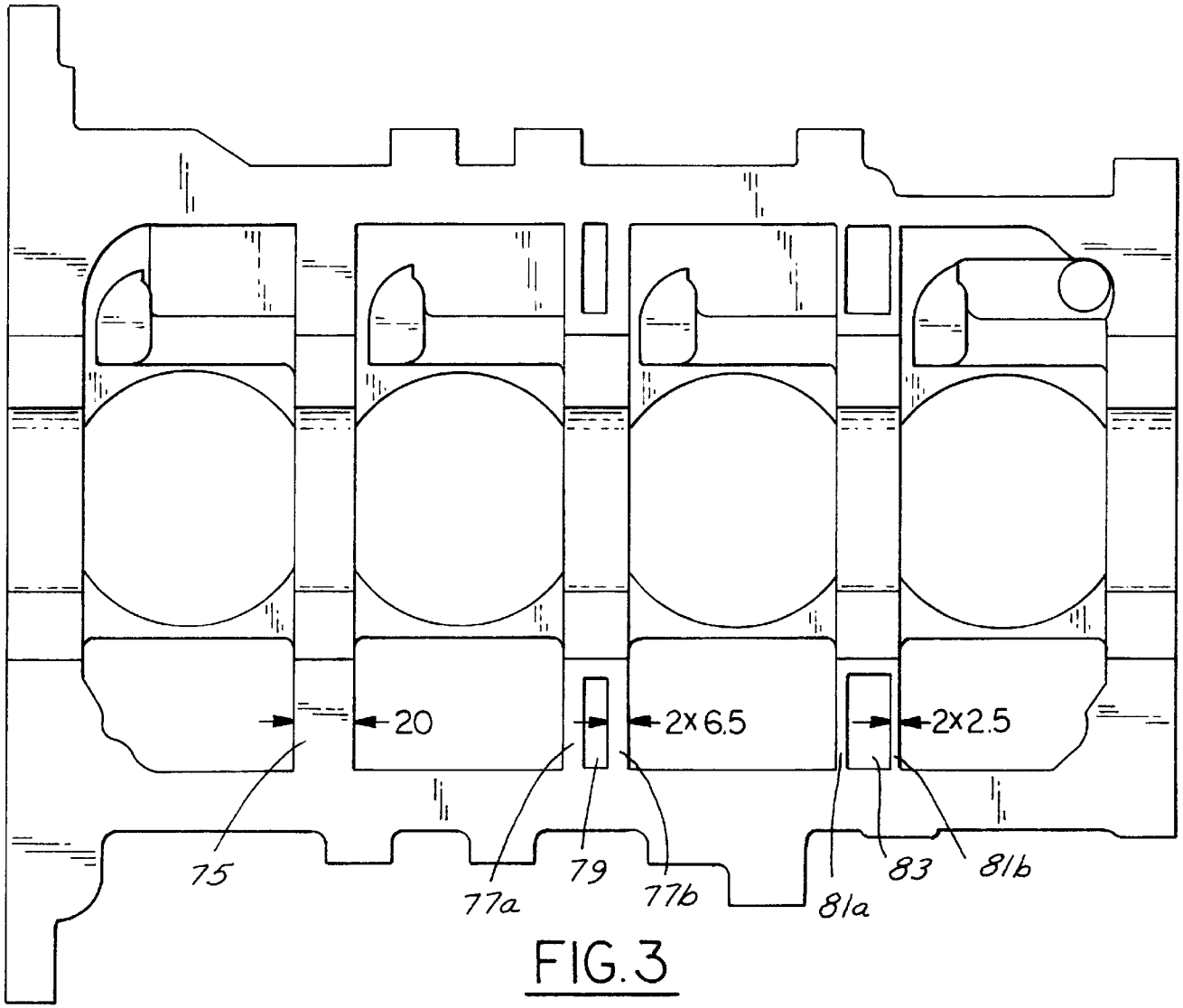
FIG. 3 illustrates a cylinder block according to one aspect of the present invention.

During the actual casting process, the mold is filled with a melt having a composition capable of producing the desired material properties upon differential cooling. For example, grey iron having chemistry adjusted with manganese and other elements is well-known to those skilled in the art, as are the cooling rates required to produce the levels of nodularity and compacted graphite iron described herein. Once the mold is filled, the mold and cast part are allowed to cool at the selected cooling rates achieved by the surface to volume ratio and section thicknesses. If desired, external cooling may be applied to achieve the selected cooling rates. These and other details are committed to the discretion of those skilled in the art and armed with the information contained in this specification. As shown in FIG. 3, an engine cylinder block is illustrated with three different types of main bearing bulkheads, which are similar to bulkhead 24 in FIG. 1. Bulkhead 75 is approximately 20 mm in thickness and is made of solid iron. Bulkhead 77 has two webs 77*a* and 77*b*, forming a box beam bulkhead with a hollow core 79. Hollow core 79 has a variable volume which can be expanded as shown with core 83, to permit adjustment of the surface-to-volume ratio of the bulkhead. Thus, webs 77*a* and 77*b* would be expected to cool more rapidly than web 75, and less rapidly than webs 81*a* and 81*b*. As a result, the nodularity of webs 77*a* and 77*b* would lie somewhere between the nodularity achieved with webs 81*a* and 81*b* and web 75. Thus, it may be seen that at least one zone in the cylinder block of FIG. 3 has a hollow core with variable volume so as to permit adjustment of the surface-to-volume ratio of the zone without changing the outer surface of the zone. This is important for engine construction because the stiffness of the section or zone may be maintained while at the same time reducing the weight. Although reference WO93/20969 shows various zones with differing section thicknesses, the '969 reference does not show any structure for varying the surface-to-volume ratio of a zone without changing the outer dimensions of the zone. The '696 reference merely shows thinning down a section wall, which will have the effect of decreasing the section stiffness—an undesirable characteristic. For example, it may be desirable to use special gating to produce the temperature gradients required to achieve the differential cooling described herein. It is believed that such mechanical expediencies may be achieved by those skilled in the art without undue experimentation.

While the invention has been shown and described in its preferred embodiments, it will be clear to those skilled in the arts to which it pertains that many changes and modifications may be made thereto without departing from the scope of the invention. For example, the present system may be employed to cast parts other than engine cylinder blocks, from metals other than grey iron.

What is claimed is:

1. A cylinder block for an internal combustion engine, comprising a unitary iron casting having a number of component zones, with each of said zones having a selected surface to volume ratio and a selected section thickness sufficient to cause in-mold cooling during the casting process at controllable, but varying, rates sufficient to result in different percentages of nodular and compacted graphite iron in at least two of the zones of the cylinder block, with at least one of said zones having a hollow core with variable volume, so as to permit adjustment of the surface to volume ratio of the zone.

2. A cylinder block according to claim 1, wherein said iron casting is poured from grey iron.

3. A cylinder block according to claim 1, wherein said surface to volume ratio and said section thickness are selected to cause cooling at a rate in excess of 4.5° K/sec. during cooling in the region of 1150°–1000° C. in each zone in which at least 85% nodular iron is obtained.

4. A cylinder block according to claim 1, wherein said surface to volume ratio and said section thickness are selected to cause cooling at a rate which is less than 1.5° K/sec. during cooling in the region of 1150°–1000° C. in each zone in which at least 85% compacted graphite iron is obtained.

5. A cylinder block according to claim 1, wherein said surface to volume ratio and said section thickness are selected to cause cooling at a rate which is less than 2.5° K/sec. but greater than 1.5° K/sec. during cooling in the region of 1150°–1000° C. in each zone in which at least 50–85% compacted graphite iron is obtained.

6. A cylinder block according to claim 1, wherein said surface to volume ratio and said section thickness are selected to cause cooling at a rate which is less than 4.5° K/sec. but greater than 2.5° K/sec. during cooling in the region of 1150°–1000° C. in each zone in which at least 50–85% nodular iron is obtained.

7. A cylinder block for an internal combustion engine, comprising a unitary iron casting having a number of component zones, with each of said zones having a selected surface to volume ratio and a selected section thickness sufficient to cause in-mold cooling during the casting process at controllable, but varying, rates sufficient to result in different percentages of nodular and compacted graphite iron in at least two of the zones of the cylinder block, with at least one of said zones comprising a box beam main bearing bulkhead having a hollow core of variable volume, so as to permit adjustment of the surface to volume ratio of the bulkhead without altering the outer dimensions of the bulkhead.

* * * * *